US009501961B2

(12) United States Patent
Wang et al.

(10) Patent No.: US 9,501,961 B2
(45) Date of Patent: Nov. 22, 2016

(54) DISPLAY PANEL AND DISPLAY DEVICE

(71) Applicant: SHENZHEN CHINA STAR OPTOELECTRONICS TECHNOLOGY CO., LTD., Shenzhen, Guangdong (CN)

(72) Inventors: Cong Wang, Shenzhen (CN); Peng Du, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 219 days.

(21) Appl. No.: 14/387,754

(22) PCT Filed: Jul. 29, 2014

(86) PCT No.: PCT/CN2014/083188

§ 371 (c)(1),
(2) Date: Sep. 24, 2014

(87) PCT Pub. No.: WO2015/184680

PCT Pub. Date: Dec. 10, 2015

(65) Prior Publication Data

US 2016/0247434 A1 Aug. 25, 2016

(30) Foreign Application Priority Data

Jun. 7, 2014 (CN) ..... 2014 1 0251014

(51) Int. Cl.
*G09G 5/02* (2006.01)
*G09G 3/20* (2006.01)

(52) U.S. Cl.
CPC ..... *G09G 3/2003* (2013.01); *G09G 3/2074* (2013.01); *G09G 3/2085* (2013.01); *G09G 2310/0202* (2013.01)

(58) Field of Classification Search
CPC combination set(s) only.
See application file for complete search history.

(56) References Cited

U.S. PATENT DOCUMENTS 9,318,040 B1 * 4/2016 Tsai ..... G09G 3/2003
2010/0225747 A1 * 9/2010 Chen ..... G09G 3/003 348/51
2010/0277463 A1 * 11/2010 Yen ..... G09G 3/20 345/213
2011/0310057 A1 * 12/2011 Wang ..... G02F 1/13338 345/174
2015/0070256 A1 * 3/2015 Gu ..... G09G 3/3413 345/88

* cited by examiner

*Primary Examiner* — Wesner Sajous
(74) *Attorney, Agent, or Firm* — Sughrue Mion, PLLC

(57) ABSTRACT

A display panel is disclosed. The display panel includes: at least one first data line, at least one second data line, at least two first pixel columns, and at least two second pixel columns. In two adjacent ones of subpixel rows, the first data line is electrically connected to one of first subpixels in one of the first pixel columns and one of second subpixels in one of the second pixel columns, and the second data line is electrically connected to one of the second subpixels in the one of the second pixel columns and one of the first subpixels in another one of the first pixel columns adjacent to the one of the second pixel columns.

20 Claims, 7 Drawing Sheets

DISPLAY PANEL AND DISPLAY DEVICE

BACKGROUND OF THE INVENTION

1. Field of the Invention

The present invention generally relates to a display technical field, and more particularly to a display panel and a display device.

2. Description of Prior Art

A traditional display panel 10 is shown in FIG. 1. D1-D5 are data lines, and G1-G10 are scan lines (gate lines).

In order to save cost, the traditional display panel 10 adopts a technical scheme in which a signal source end has a high pin count. For example, only one fanout and an integrated circuit (IC) are utilized in the signal source end. In this situation, a resistance difference of the fanout is generally larger.

In practice, the following problem exists in the prior art. Color shift phenomenon occurs at two sides of the display panel 10 due to the larger resistance difference of the fanout in the signal source end when a color mixture image is displayed.

Specifically, in a color mixture image, the data lines D1-D5 continuously charge two subpixels by inputting data signals. Then, the data lines D1-D5 charge two subpixels of a next pixel. Since the resistance of the fanout is larger, resistance-capacitance delay (RC delay) of a signal is serious. A charged condition of the first subpixel is worse than a charged condition of the second subpixel. The color shift phenomenon occurs due to the difference of the charged conditions of the subpixels especially at the two sides of the display panel 10 (the positions in which a largest fanout line resistance occurs in the signal source end).

As shown in FIG. 2, FIG. 2 shows a color mixture image of a red color and a blue color displayed by the traditional display panel 10. The signals provided by the fanout lines sequentially turn on the scan lines G1, G2, G3, . . . , G2*n*−1, G2*n* one by one.

The scan lines of the display panel 10 are turned on one by one from top to bottom (along the first direction 201). Since the resistance difference of the fanout in the source end between the middle area 102 and the two side areas 101 (as shown in FIG. 3) of the display panel 10 is large, the RC delay conditions of the signals of the data lines are also different. The RC delay conditions of the data signals received by the subpixels in the two side areas 101 of the display panel 10 are more serious. For example, in the waveform in the middle area 102 as shown in FIG. 4A and in the waveform in the two side areas 101 as shown in FIG. 4B, the data lines charge the blue subpixels firstly and then charge the red subpixels. Since the RC delay of the signal waveform in the two side areas 101 of the display panel 10 is more serious, all the charged conditions of the blue subpixels are worse than the charged conditions of the red subpixels as compared with those in the middle area 102.

Accordingly, when a purple image is displayed in the two areas 101 of the display panel 10, the purple image tends to be reddish. In contrast, when the scan direction 201 is in an opposite direction, the purple image in the two side areas 101 tends to be bluish. Likewise, the problem also occurs when a yellow image or an aqua blue image is displayed.

Consequently, there is a need to provide a new technical scheme for solving the above-mentioned technical problem.

SUMMARY OF THE INVENTION

An objective of the present invention is to provide a display panel and a display device capable of avoiding the color shift phenomenon in two side areas of the display panel.

To solve the above-mentioned problem, a technical scheme of the present invention is described as follows. A display panel comprises: a pixel array, comprising: at least two first pixel columns, each of the first pixel columns comprising at least two first pixels, the at least two first pixels being arranged in a matrix form in a first direction, each of the first pixels comprising at least three first subpixels, and the at least three first subpixels being arranged according to a first predetermined sequence in the first direction; and at least two second pixel columns, each of the second pixel columns comprising at least two second pixels, the at least two second pixels being arranged in a matrix form in the first direction, each of the second pixels comprising at least three second subpixels, and the at least three second subpixels being arranged according to a second predetermined sequence in the first direction, wherein the first pixel columns and the second pixel columns are parallelly arranged in a second direction, and the second direction is perpendicular to the first direction; at least one first data line being electrically connected to one of the first pixel columns and one of the second pixel columns; at least one second data line being electrically connected to the one of the second pixel columns and another one of the first pixel columns adjacent to the one of the second pixel columns; and at least two scan lines being parallel to the second direction, the at least two scan lines being arranged in a matrix form in the first direction, and each of the scan lines being electrically connected to each of subpixels in corresponding one of subpixel rows; wherein in two adjacent ones of the subpixel rows, the first data line is electrically connected to one of the first subpixels in the one of the first pixel columns and one of the second subpixels in the one of the second pixel columns, and the second data line is electrically connected to one of the second subpixels in the one of the second pixel columns and one of the first subpixels in the another one of the first pixel columns adjacent to the one of the second pixel columns; the subpixel rows are parallel to the second direction, and the subpixel rows at least comprise the first subpixels and the second subpixels; the at least two scan lines are utilized for transmitting scan signals to the subpixel rows electrically connected to the scan lines according to a predetermined sequence in the first direction; and in the second direction, at least one of the second pixel columns is disposed between two of the first pixel columns, and at least one of the first pixel columns is disposed between two of the second pixel columns.

In the above-mentioned display panel, the three first subpixels of the first pixel comprise a first red subpixel, a first green subpixel, and a first blue subpixel, and the three second subpixels of the second pixel comprise a second red subpixel, a second green subpixel, and a second blue subpixel; and in the second direction, the first red subpixel and the second red subpixel are alternately arranged, the first green subpixel and the second green subpixel are alternately arranged, and the first blue subpixel and the second blue subpixel are alternately arranged.

In the above-mentioned display panel, at least two of the first red subpixels in the first pixel columns and at least two of the second red subpixels in the second pixel columns are arranged in a first oblique line, at least two of the first green subpixels in the first pixel columns and at least two of the second green subpixels in the second pixel columns are arranged in a second oblique line, and at least two of the first blue subpixels in the first pixel columns and at least two of the second blue subpixels in the second pixel columns are arranged in a third oblique line; and an angle between the first oblique line and the second direction, an angle between the second oblique line and the second direction, and an angle between the third oblique line and the second direction are the same.

In the above-mentioned display panel, at least two of the first red subpixels in the first pixel columns and at least two of the second red subpixels in the second pixel columns are arranged in at least one first wavy line, at least two of the first green subpixels in the first pixel columns and at least two of the second green subpixels in the second pixel columns are arranged in at least one second wavy line, and at least two of the first blue subpixels in the first pixel columns and at least two of the second blue subpixels in the second pixel columns are arranged in at least one third wavy line.

In the above-mentioned display panel, the predetermined sequence is corresponding to an arrangement sequence of the scan lines in the first direction.

In the above-mentioned display panel, a transmitting time difference between two scan signals of two adjacent ones of the scan lines has a predetermined time.

A display panel comprises: a pixel array, comprising: at least two first pixel columns, each of the first pixel columns comprising at least two first pixels, the at least two first pixels being arranged in a matrix form in a first direction, each of the first pixels comprising at least three first subpixels, and the at least three first subpixels being arranged according to a first predetermined sequence in the first direction; and at least two second pixel columns, each of the second pixel columns comprising at least two second pixels, the at least two second pixels being arranged in a matrix form in the first direction, each of the second pixels comprising at least three second subpixels, and the at least three second subpixels being arranged according to a second predetermined sequence in the first direction, wherein the first pixel columns and the second pixel columns are parallelly arranged in a second direction, and the second direction is perpendicular to the first direction; at least one first data line being electrically connected to one of the first pixel columns and one of the second pixel columns; and at least one second data line being electrically connected to the one of the second pixel columns and another one of the first pixel columns adjacent to the one of the second pixel columns; wherein in two adjacent ones of subpixel rows, the first data line is electrically connected to one of the first subpixels in the one of the first pixel columns and one of the second subpixels in the one of the second pixel columns, and the second data line is electrically connected to one of the second subpixels in the one of the second pixel columns and one of the first subpixels in the another one of the first pixel columns adjacent to the one of the second pixel columns; the subpixel rows are parallel to the second direction, and the subpixel rows at least comprise the first subpixels and the second subpixels.

In the above-mentioned display panel, the three first subpixels of the first pixel comprise a first red subpixel, a first green subpixel, and a first blue subpixel, and the three second subpixels of the second pixel comprise a second red subpixel, a second green subpixel, and a second blue subpixel; and in the second direction, the first red subpixel and the second red subpixel are alternately arranged, the first green subpixel and the second green subpixel are alternately arranged, and the first blue subpixel and the second blue subpixel are alternately arranged.

In the above-mentioned display panel, at least two of the first red subpixels in the first pixel columns and at least two of the second red subpixels in the second pixel columns are arranged in a first oblique line, at least two of the first green subpixels in the first pixel columns and at least two of the second green subpixels in the second pixel columns are arranged in a second oblique line, and at least two of the first blue subpixels in the first pixel columns and at least two of the second blue subpixels in the second pixel columns are arranged in a third oblique line; and an angle between the first oblique line and the second direction, an angle between the second oblique line and the second direction, and an angle between the third oblique line and the second direction are the same.

In the above-mentioned display panel, at least two of the first red subpixels in the first pixel columns and at least two of the second red subpixels in the second pixel columns are arranged in at least one first wavy line, at least two of the first green subpixels in the first pixel columns and at least two of the second green subpixels in the second pixel columns are arranged in at least one second wavy line, and at least two of the first blue subpixels in the first pixel columns and at least two of the second blue subpixels in the second pixel columns are arranged in at least one third wavy line.

The above-mentioned display panel further comprises: at least two scan lines being parallel to the second direction, the at least one scan lines being arranged in a matrix form in the first direction, and each of the scan lines being electrically connected to each of subpixels in corresponding one of the subpixel rows; wherein the at least two scan lines are utilized for transmitting scan signals to the subpixel rows electrically connected to the scan lines according to a predetermined sequence in the first direction.

In the above-mentioned display panel, the predetermined sequence is corresponding to an arrangement sequence of the scan lines in the first direction.

In the above-mentioned display panel, a transmitting time difference between two scan signals of two adjacent ones of the scan lines has a predetermined time.

A display device comprises: a scan driving circuit for providing scan signals; a data driving circuit for providing data signals; and a display panel, the scan driving circuit and the data driving circuit being electrically connected to the display panel, the display panel comprising: a pixel array, comprising: at least two first pixel columns, each of the first pixel columns comprising at least two first pixels, the at least two first pixels being arranged in a matrix form in a first direction, each of the first pixels comprising at least three first subpixels, and the at least three first subpixels being arranged according to a first predetermined sequence in the first direction; and at least two second pixel columns, each of the second pixel columns comprising at least two second pixels, the at least two second pixels being arranged in a matrix form in the first direction, each of the second pixels comprising at least three second subpixels, and the at least three second subpixels being arranged according to a second predetermined sequence in the first direction, wherein the first pixel columns and the second pixel columns are parallelly arranged in a second direction, and the second direction is perpendicular to the first direction; at least one first data line being electrically connected to one of the first pixel columns and one of the second pixel columns; and at least one second data line being electrically connected to the one of the second pixel columns and another one of the first pixel columns adjacent to the one of the second pixel columns, wherein in two adjacent ones of subpixel rows, the first data line is electrically connected to one of the first subpixels in the one of the first pixel columns and one of the second subpixels in the one of the second pixel columns, and the second data line is electrically connected to one of the second subpixels in the one of the second pixel columns and one of the first subpixels in the another one of the first pixel columns adjacent to the one of the second pixel columns; and the subpixel rows are parallel to the second direction, and the subpixel rows at least comprise the first subpixels and the second subpixels.

In the above-mentioned display device, the three first subpixels of the first pixel comprise a first red subpixel, a first green subpixel, and a first blue subpixel, and the three second subpixels of the second pixel comprise a second red subpixel, a second green subpixel, and a second blue subpixel; and in the second direction, the first red subpixel and the second red subpixel are alternately arranged, the first green subpixel and the second green subpixel are alternately arranged, and the first blue subpixel and the second blue subpixel are alternately arranged.

In the above-mentioned display device, at least two of the first red subpixels in the first pixel columns and at least two of the second red subpixels in the second pixel columns are arranged in a first oblique line, at least two of the first green subpixels in the first pixel columns and at least two of the second green subpixels in the second pixel columns are arranged in a second oblique line, and at least two of the first blue subpixels in the first pixel columns and at least two of the second blue subpixels in the second pixel columns are arranged in a third oblique line; and an angle between the first oblique line and the second direction, an angle between the second oblique line and the second direction, and an angle between the third oblique line and the second direction are the same.

In the above-mentioned display device, at least two of the first red subpixels in the first pixel columns and at least two of the second red subpixels in the second pixel columns are arranged in at least one first wavy line, at least two of the first green subpixels in the first pixel columns and at least two of the second green subpixels in the second pixel columns are arranged in at least one second wavy line, and at least two of the first blue subpixels in the first pixel columns and at least two of the second blue subpixels in the second pixel columns are arranged in at least one third wavy line.

In the above-mentioned display device, the display panel further comprises at least two scan lines being parallel to the second direction, the at least two scan lines are arranged in a matrix form in the first direction, and each of the scan lines are electrically connected to each of subpixels in corresponding one of the subpixel rows; and the at least two scan lines are utilized for transmitting the scan signals to the subpixel rows electrically connected to the scan lines according to a predetermined sequence in the first direction.

In the above-mentioned display device, the predetermined sequence is corresponding to an arrangement sequence of the scan lines in the first direction.

In the above-mentioned display device, a transmitting time difference between two scan signals of two adjacent ones of the scan lines has a predetermined time.

Compared with the prior art, the present invention can reduce the difference of the charged conditions of the subpixels of different colors, thereby avoiding the color shift phenomenon in the two side areas of the display panel.

For a better understanding of the aforementioned content of the present invention, preferable embodiments are illustrated in accordance with the attached figures for further explanation:

DETAILED DESCRIPTION OF THE INVENTION

The following descriptions for the respective embodiments are specific embodiments capable of being implemented for illustrations of the present invention with reference to the appended figures.

A display device of the present invention comprises a display panel 50, a scan driving circuit 52, and a data driving circuit 54. The scan driving circuit 52 is utilized for providing scan signals, and the data driving circuit 54 is utilized for providing data signals. The scan driving circuit 52 and the data driving circuit 54 are electrically connected to the display panel 50.

Figure 5:
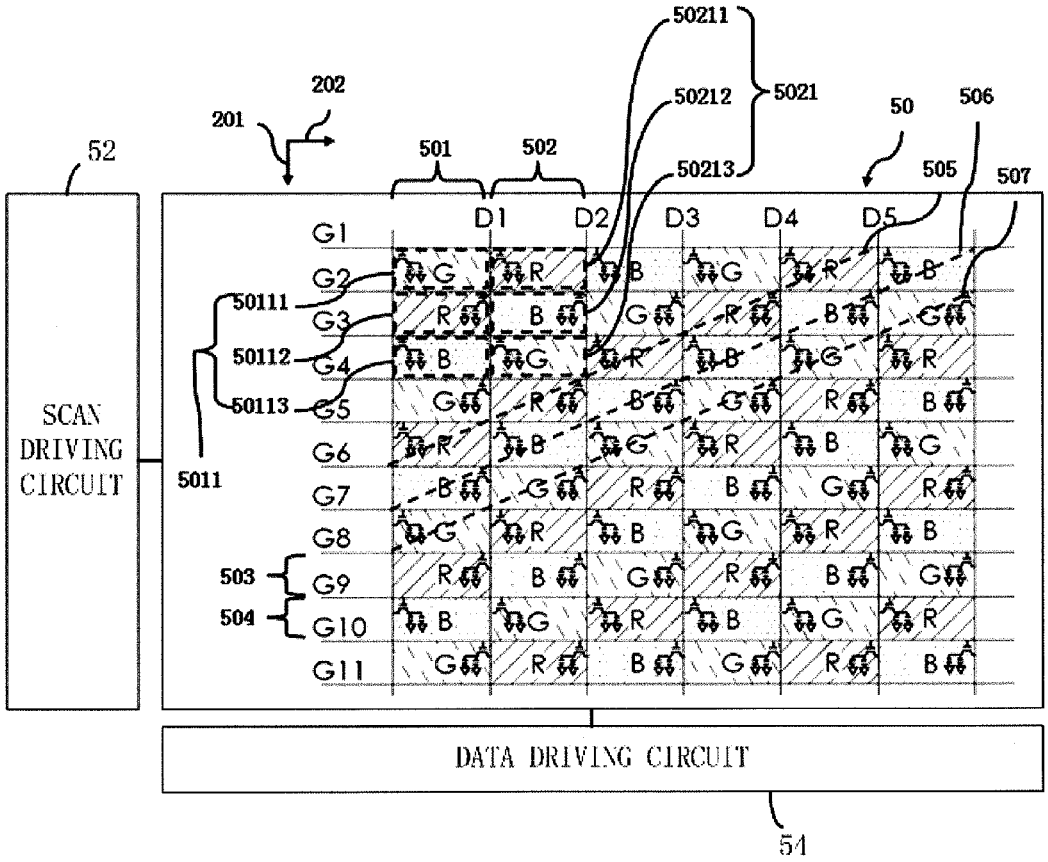
FIG. 5 shows a display panel in accordance with a first embodiment of the present invention.

Please refer to FIG. 5. FIG. 5 shows the display panel 50 in accordance with a first embodiment of the present invention.

The display panel 50 in the present embodiment comprises a pixel array, at least two scan lines, at least one first data line D1, and at least one second data line D2. The scan driving circuit 52 is electrically connected to the scan lines, and the data driving circuit 54 is electrically connected to the first data line D1 and the second data line D2.

The pixel array comprises at least two first pixel columns 501 and at least two second pixel columns 502. Each of the first pixel columns 501 comprises at least two first pixels 5011. The at least two first pixels 5011 are arranged in a matrix form in a first direction 201. Each of the first pixels 5011 comprises at least three first subpixels (50112, 50111, and 50113). The at least three first subpixels (50112, 50111, and 50113) are arranged according to a first predetermined sequence in the first direction 201. Each of the second pixel columns 502 comprises at least two second pixels 5021. The at least two second pixels 5021 are arranged in a matrix form in the first direction 201. Each of the second pixels 5021 comprises at least three second subpixels (50213, 50212, and 50211). The at least three second subpixels (50213, 50212, and 50211) are arranged according to a second predetermined sequence in the first direction 201. The first predetermined sequence is different from the second predetermined sequence.

The first pixel columns 501 and the second pixel columns 502 are parallelly arranged in a second direction 202. Furthermore, in the second direction, at least one of the second pixel columns 502 is disposed between two of the first pixel columns 501, and at least one of the first pixel columns 501 is disposed between two of the second pixel columns 502. The second direction 202 is perpendicular to the first direction 501.

The first data line D1 is electrically connected to one of the first pixel columns 501 and one of the second pixel columns 502. The second data line D2 is electrically connected to the one of the second pixel columns 502 and another one of the first pixel columns 501 adjacent to the one of the second pixel columns 502.

The scan lines are parallel to the second direction 202, and the scan lines are arranged in a matrix form in the first direction 201.

The scan lines are electrically connected to the subpixels of the pixel array. Specifically, each of the scan lines is electrically connected to each of the subpixels in corresponding one of subpixel rows (503 and 504). The data lines (including the first data lines D1 and the second data lines D2) are electrically connected to the subpixels of the pixel array. The scan lines are utilized for providing the scan signals provided by the scan driving circuit 52 for the subpixels which are electrically connected to the scan lines. Correspondingly, the data lines are utilized for providing the data signals provided by the data driving circuit 54 for the subpixels which are electrically connected to the data lines. The subpixel rows (503 and 504) are parallel to the second direction 202. The subpixel rows (503 and 504) at least comprise the first subpixels (50112, 50111, and 50113) and the second subpixels (50213, 50212, and 50211). That is, the first subpixels (50112, 50111, and 50113) and the second subpixels (50213, 50212, and 50211) in the subpixels (503 and 504) are arranged in the second direction 202.

In the present embodiment, the at least two scan lines are utilized for transmitting the scan signals to the subpixel rows (503 and 504) according to a predetermined sequence in the first direction 201. The predetermined sequence is corresponding to an arrangement sequence of the scan lines in the first direction 201. A transmitting time difference between two scan signals of two adjacent ones of the scan lines has a predetermined time.

In two adjacent ones of the subpixel rows (503 and 504), the first data line D1 is electrically connected to one of the first subpixels (50112, 50111, and 50113) in the one of the first pixel columns 501 and one of the second subpixels (50213, 50212, and 50211) in the one of the second pixel columns 502, and the second data line D2 is electrically connected to one of the second subpixels (50213, 50212, and 50211) in the one of the second pixel columns 502 and one of the first subpixels (50112, 50111, and 50113) of another one of the first pixel columns 501 adjacent to the one of the second pixel columns 502.

That is, in each of the second pixel columns 502, at least one subpixel which is electrically connected to the second data line D2 is disposed between any two of the subpixels which are electrically connected to the first data line D1, and at least one subpixel which is electrically connected to the first data line D1 is disposed between any two of the subpixels which are electrically connected to the second data line D2. In each of the first pixel columns 501, at least one subpixel which is electrically connected to another second data line D2 is disposed between any two of the subpixels which are electrically connected to the first data line D1, and at least one subpixel which is electrically connected to the first data line D1 is disposed between any two of the subpixels which are electrically connected to the another second data line D2. The another second data line D2 is another second data line adjacent to the first data line D1.

In the present embodiment, the three first subpixels (50112, 50111, and 50113) of the first pixel 5011 comprise a first red subpixel 50112, a first green subpixel 50111, and a first blue subpixel 50113. The three second subpixels (50213, 50212, and 50211) of the second pixel 5021 comprise a second red subpixel 50211, a second green subpixel 50213, and a second blue subpixel 50212. In the second direction, the first red subpixel 50112 and the second red subpixel 50211 are alternately arranged, the first green subpixel 50111 and the second green subpixel 50213 are alternately arranged, and the first blue subpixel 50113 and the second blue subpixel 50212 are alternately arranged.

The subpixels with the same color (R, G, or B) in the display panel 50 are arranged in an oblique line, and the green subpixels are disposed at the left of the red subpixels.

Based on the driving timing, a sequence for transmitting the scan signals/gate switching signals with the scan lines of the display panel 50 is: G1→G2→G3→G4→ . . . →G10→G11→ . . . →G2*n*−1→G2*n*.

A sequence for charging the subpixels in a first one of the first pixel columns 501 and a first one of the second pixel columns 502 with the first data line D1 is: R→R→G→G→B→B→ . . . . A sequence for charging the subpixels in a second one of the first pixel columns 501 and the first one of the second pixel columns 502 with the second data line D2 is: B→B→R→R→G→G . . . R is corresponding to a red subpixel (the first red subpixel 50112 or the second red subpixel 50211). G is corresponding to a green subpixel (the first green subpixel 50111 or the second green subpixel 50213). B is corresponding to a blue subpixel (the first blue subpixel 50113 or the second blue subpixel 50212).

In the present embodiment, at least two of the first red subpixels 50112 in the first pixel columns 501 and at least two of the second red subpixels 50211 in the second pixel columns 502 are arranged in a first oblique line 505. At least two of the first green subpixels 50111 in the first pixel columns 501 and at least two of the second green subpixels 50213 in the second pixel columns 502 are arranged in a second oblique line 507. At least two of the first blue subpixels 50113 in the first pixel columns 501 and at least two of the second blue subpixels 50212 in the second pixel columns 502 are arranged in a third oblique line 506. An angle between the first oblique line 505 and the second direction 202, an angle between the second oblique line 507 and the second direction 202, and an angle between the third oblique line 506 and the second direction 202 are all the same. The first oblique line 505, the second oblique line 507, and the third oblique line 506 are arranged in a matrix form in the first direction 201.

In the present embodiment, the first oblique line 505, the second oblique line 507, and the third oblique line 506 are from the bottom left of the display panel 50 to the upper right of the display panel 50 or from the upper right of the display panel 50 to the bottom left of the display panel 50.

In the present embodiment, the data lines (the first data lines D1 and the second data lines D2) continuously charge two subpixels with the same color (color resist).

For example, a purple image which is acquired by mixing the red color and the blue color is displayed. The scan lines are turned on from top to bottom. A waveform of a data signal in a middle area 102 of the display panel 50 and a waveform of a data signal in two side areas 101 of the display panel 50 are respectively shown in FIG. 6A and FIG. 6B. The data lines (the first data lines D1 and the second data lines D2) continuously charge two subpixels with the same color.

Figure 6A:
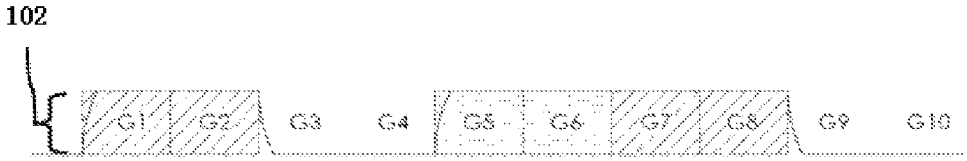
FIG. 6A and FIG. 6B respectively show color mixtures of subpixels in a middle area and two side areas of the display panel in FIG. 5.
Figure 6B:
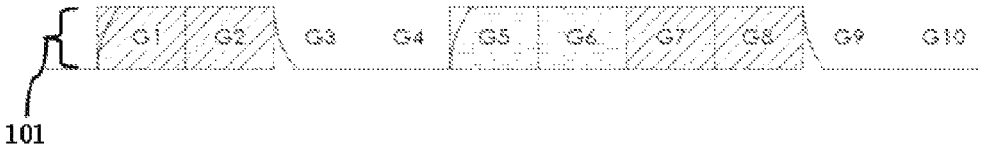

As shown in FIG. 6A and FIG. 6B, states of the pixel rows corresponding to the scan lines G1-G10 are shown in Table 1 when the display panel 50 displays one image in the present embodiment.

TABLE 1

| column | G1 | G2 | G3 | G4 | G5 | G6 | G7 | G8 | G9 | G10 |
|---|---|---|---|---|---|---|---|---|---|---|
| row state | ON | ON | OFF | OFF | ON | ON | ON | ON | OFF | OFF |

In the two side areas 101 of the display panel 50, since the RC delay is more serious, in the same pixel column (for example, one of the first pixel columns 501 or one of the second pixel columns 502), a charged condition of a first subpixel in four subpixels is worse than charged conditions of the other three subpixels in the four subpixels. For example, as shown in FIG. 6B, the charged condition of the subpixel corresponding to the scan line G5 is worse than the charged conditions of the subpixels corresponding to the scan lines G6, G7, and G8. The color of the subpixels corresponding to the scan lines G5 and G6 is blue, and the color of the subpixels corresponding to the scan lines G7 and G8 is red. On the whole, the charged condition of half a number of the red subpixels (the subpixel corresponding to the scan line G5) is different from the charged conditions of the blue subpixels (the subpixels corresponding to the scan lines G7 and G8), and the other half of the number of the red subpixels (the subpixel corresponding to the scan line G6) is the same as the charged conditions of the blue subpixels (the subpixels corresponding to the scan lines G7 and G8).

Assuming that a value of the charged condition of the subpixel G5 corresponding to the scan line G5 is 0.5 and a value of the charged condition of each of the subpixels G6, G7, and G8 is 1, a mixed result of the subpixels corresponding to the scan lines G5, G6, G7, and G8 in the two side areas 101 is (G5+G6):(G7+G8)=(0.5+1):(1+1)=0.75:1.

Figure 1:
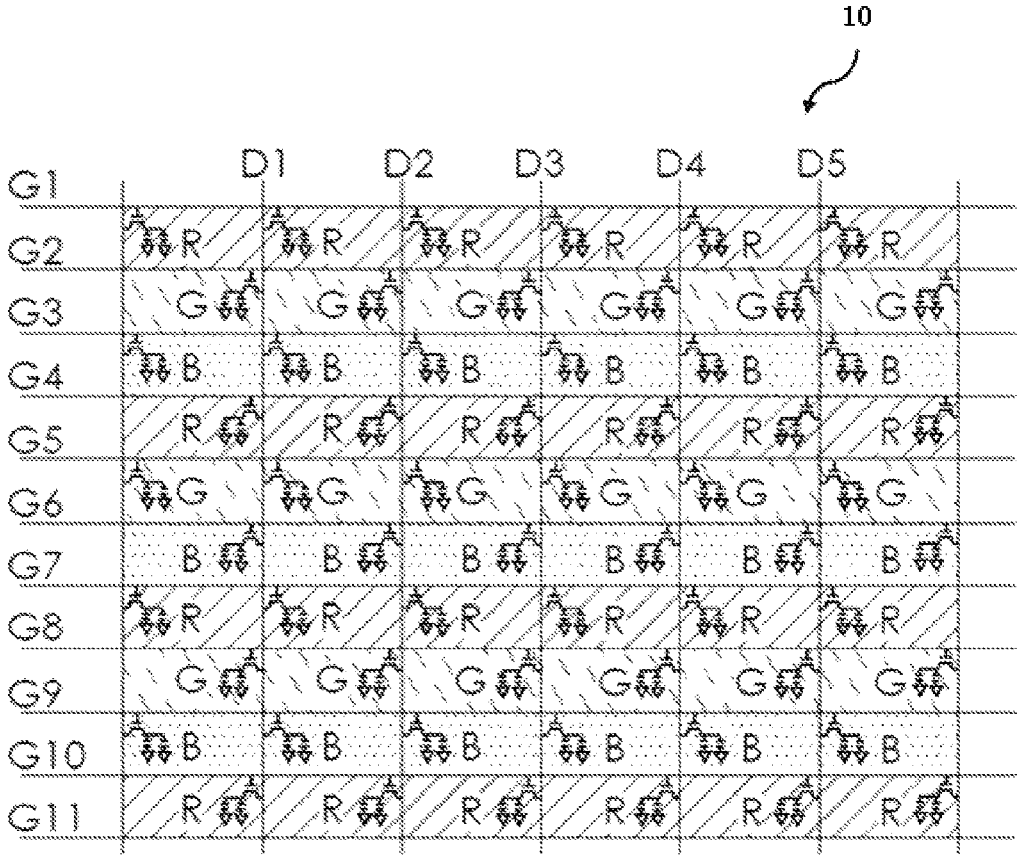
FIG. 1 (PRIOR ART)
FIG. 1 shows a traditional display panel.
Figure 2:
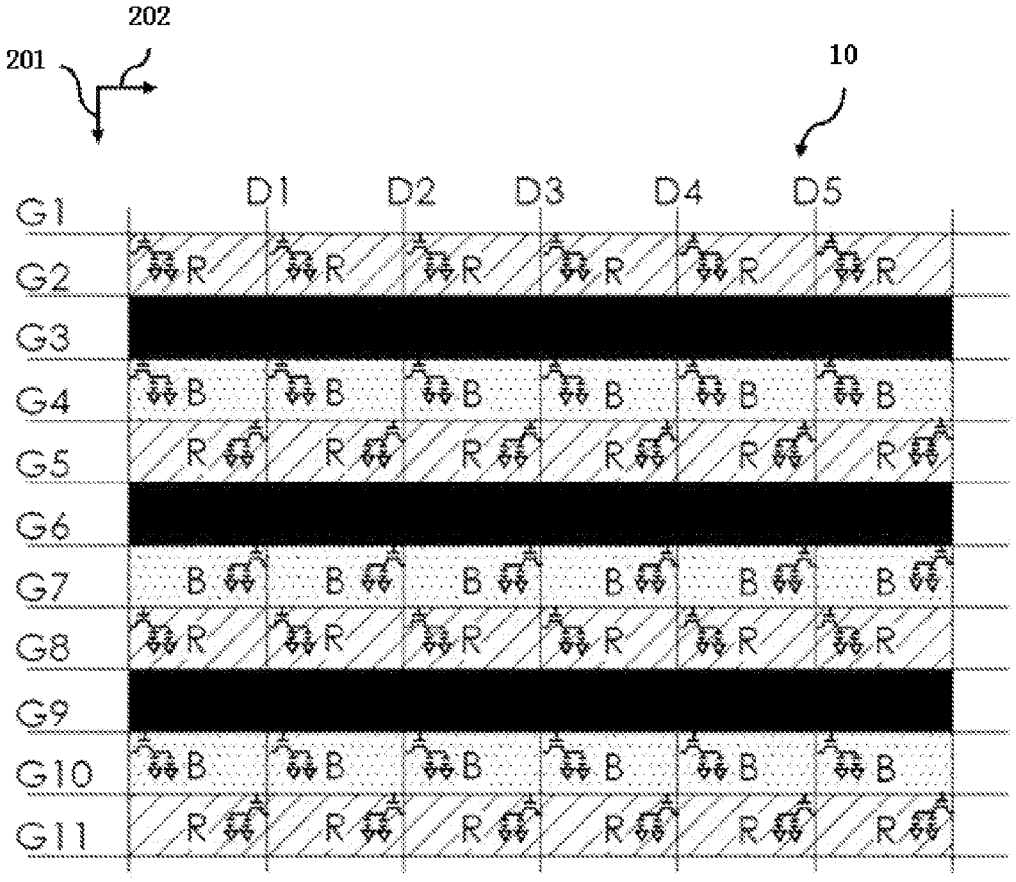
FIG. 2 (PRIOR ART)
FIG. 2 shows a color mixture image of a red color and a blue color displayed by the traditional display panel in FIG. 1.
Figure 3:
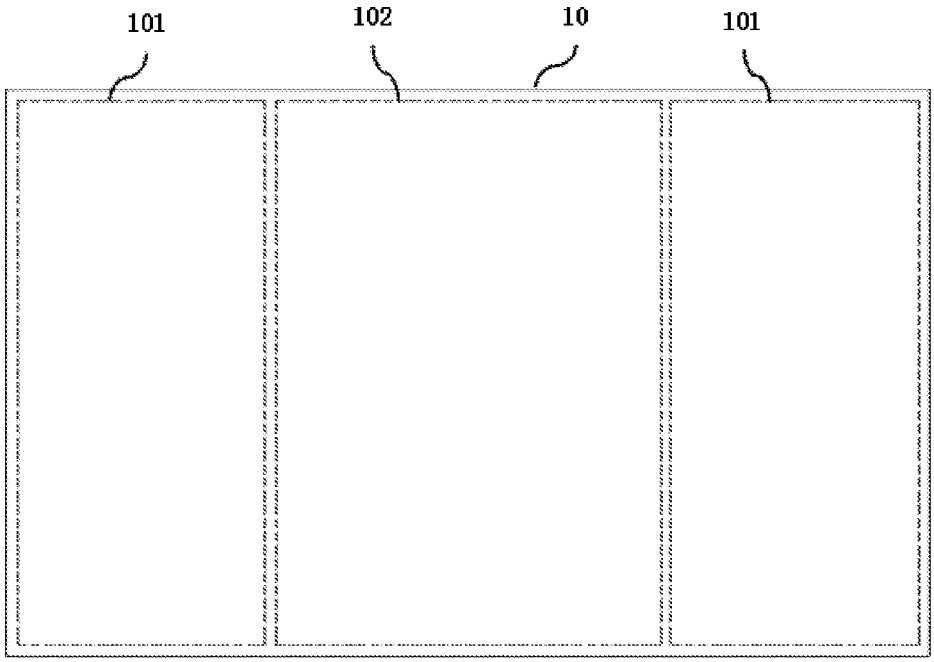
FIG. 3 (PRIOR ART)
FIG. 3 shows the color mixture image in different areas in FIG. 2.
Figure 4A:
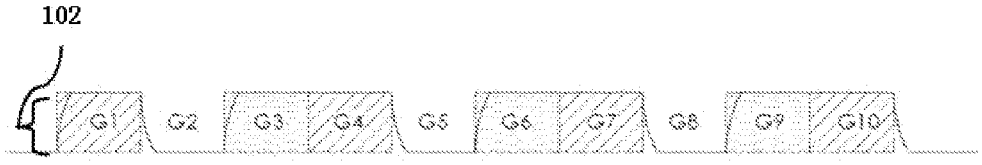
FIG. 4A (PRIOR ART)
FIG. 4A and FIG. 4B respectively show color mixtures of subpixels in a middle area and two side areas of the display panel in FIG. 3.
Figure 4B:
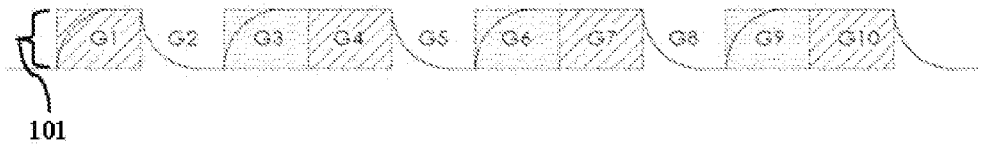
FIG. 4B (PRIOR ART)

In contrast, in the traditional display panel 10, the charged conditions of the red subpixels and the charged conditions of the blue subpixels in the two side areas 101 are different. As shown in FIG. 4B, a mixed result of the red subpixel (the subpixel corresponding to the scan line G6) and the blue subpixel (the subpixel corresponding to the scan line G7) in the two side areas 101 is (G6):(G7)=0.5:1.

Apparently, the above-mentioned technical scheme can effectively reduce the difference between the charged conditions of subpixels of different colors, thereby significantly decreasing the color shift phenomenon in the two side areas 101.

Figure 7:
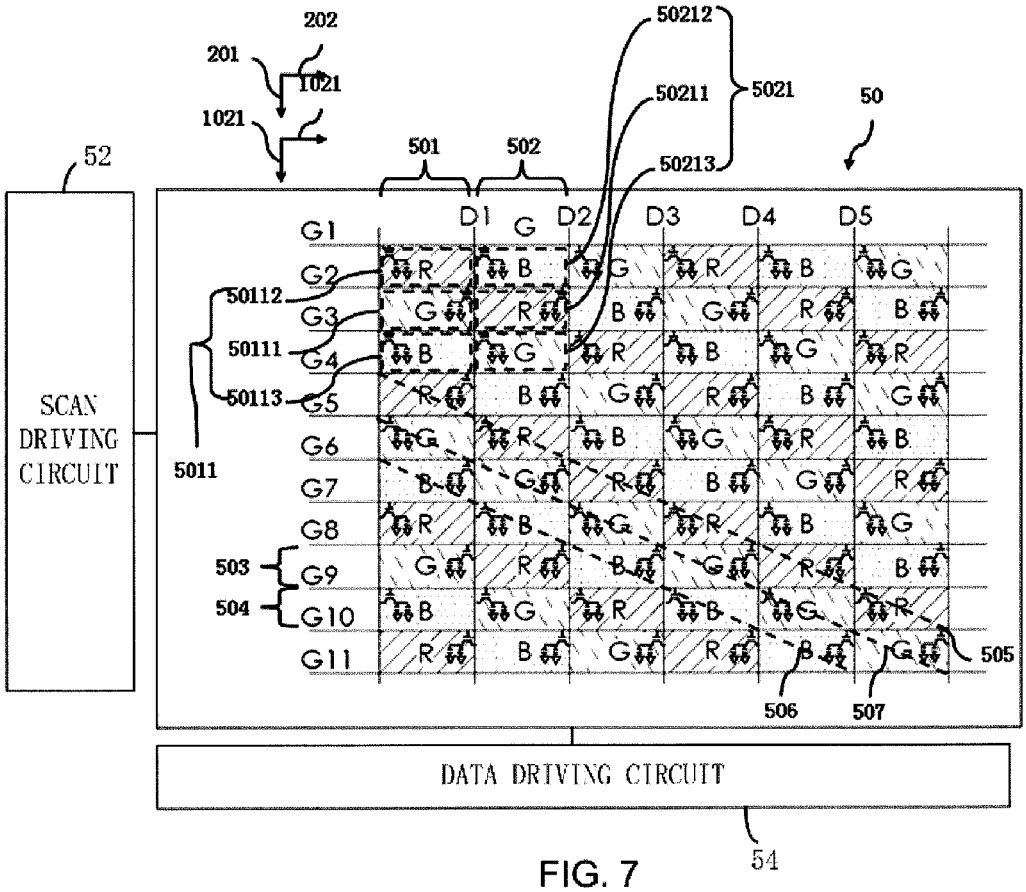
FIG. 7 shows a display panel in accordance with a second embodiment of the present invention.

Please refer to FIG. 7. FIG. 7 shows the display panel 50 in accordance with a second embodiment of the present invention. The present embodiment is similar to the first embodiment. A difference is described as follows.

In the present embodiment, the first oblique line 505, the second oblique line 507, and the third oblique line 506 are from the upper left of the display panel 50 to the bottom right of the display panel 50 or from the bottom right of the display panel 50 to the upper left of the display panel 50.

In the present embodiment, a sequence for transmitting the scan signals/gate switching signals with the scan lines of the display panel 50 is: G1→G2→G3→G4→ . . . →G10→G11→ . . . →G2*n*−1→G2*n*.

A sequence for charging the subpixels in a first one of the first pixel columns 501 and a first one of the second pixel columns 502 with the first data line D1 is: B→G→G→R→R→B→ . . . . A sequence for charging the subpixels in a second one of the first pixel columns 501 and the first one of the second pixel columns 502 with the second data line D2 is: G→R→R→B→B→G . . . .

Figure 8:
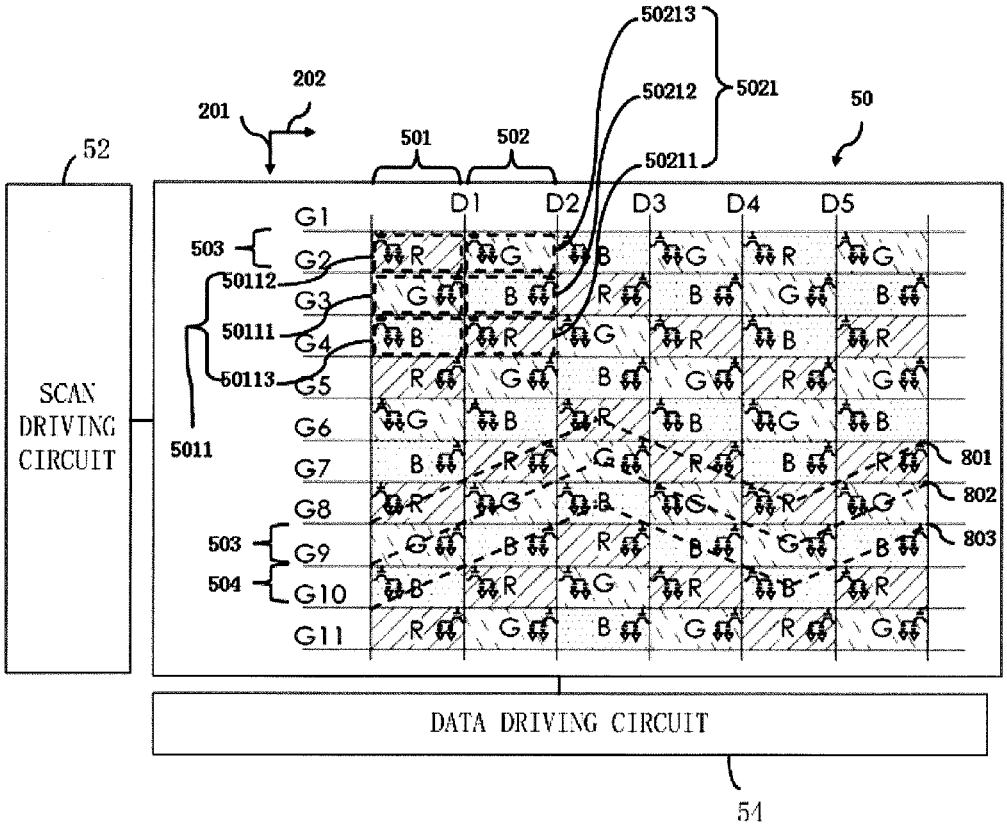
FIG. 8 shows a display panel in accordance with a third embodiment of the present invention.

Please refer to FIG. 8. FIG. 8 shows the display panel 50 in accordance with a third embodiment of the present invention. The present embodiment is similar to the first embodiment or the second embodiment. A difference is described as follows.

In the present embodiment, at least two of the first red subpixels 50112 in the first pixel columns 501 and at least two of the second red subpixels 50211 in the second pixel columns 502 are arranged in at least one first wavy line 801. At least two of the first green subpixels 50111 in the first pixel columns 501 and at least two of the second green subpixels 50213 in the second pixel columns 502 are arranged in at least one second wavy line 802. At least two of the first blue subpixels 50113 in the first pixel columns 501 and at least two of the second blue subpixels 50212 in the second pixel columns 502 are arranged in at least one third wavy line 803. The second direction 202 is a reference for the first wavy line 801, the second wavy line 802, and the third wavy line 803. That is, the first wavy line 801, the second wavy line 802, and the third wavy line 803 have wave crests and wave troughs in the second direction 202. The first wavy line 801, the second wavy line 802, and the third wavy line 803 are arranged in a matrix form in the first direction 201.

In the present embodiment, a sequence for transmitting the scan signals/gate switching signals with the scan lines of the display panel 50 is: G1→G2→G3→G4→ . . . →G10→G11→ . . . →G2*n*−1→G2*n*.

A sequence for charging the subpixels in a first one of the first pixel columns 501 and a first one of the second pixel columns 502 with the first data line D1 is: G→G→R→R→B→B→ . . . . A sequence for charging the subpixels in a second one of the first pixel columns 501 and the first one of the second pixel columns 502 with the second data line D2 is: B→B→G→G→R→R . . . .

In the display panel 50 of the present invention, the data lines charge four subpixels every time. Accordingly, only one of the four subpixels has the charged condition different from the charged conditions of the other three of the four subpixels. The difference of the charged conditions of the subpixels of different colors can be reduced, and color shift phenomenon of a color mixture image can be avoided. As a result, the display quality of the display panel 50 can be improved.

Furthermore, the display panel 50 of the present invention can extend the limitation of the fan out resistance in the source end and significantly compress the fan out height, and thus it is benefit to implement the narrow frame design.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structures.

What is claimed is:

1. A display panel, comprising:

a pixel array, comprising:

at least two first pixel columns, each of the first pixel columns comprising at least two first pixels, the at least two first pixels being arranged in a matrix form in a first direction, each of the first pixels comprising at least three first subpixels, and the at least three first subpixels being arranged according to a first predetermined sequence in the first direction; and at least two second pixel columns, each of the second pixel columns comprising at least two second pixels, the at least two second pixels being arranged in a matrix form in the first direction, each of the second pixels comprising at least three second subpixels, and the at least three second subpixels being arranged according to a second predetermined sequence in the first direction, wherein the first pixel columns and the second pixel columns are parallelly arranged in a second direction, and the second direction is perpendicular to the first direction;

at least one first data line being electrically connected to one of the first pixel columns and one of the second pixel columns;

at least one second data line being electrically connected to the one of the second pixel columns and another one of the first pixel columns adjacent to the one of the second pixel columns; and at least two scan lines being parallel to the second direction, the at least two scan lines being arranged in a matrix form in the first direction, and each of the scan lines being electrically connected to each of subpixels in corresponding one of subpixel rows;

wherein in two adjacent ones of the subpixel rows, the first data line is electrically connected to one of the first subpixels in the one of the first pixel columns and one of the second subpixels in the one of the second pixel columns, and the second data line is electrically connected to one of the second subpixels in the one of the second pixel columns and one of the first subpixels in the another one of the first pixel columns adjacent to the one of the second pixel columns;

the subpixel rows are parallel to the second direction, and the subpixel rows at least comprise the first subpixels and the second subpixels;

the at least two scan lines are utilized for transmitting scan signals to the subpixel rows electrically connected to the scan lines according to a predetermined sequence in the first direction; and in the second direction, at least one of the second pixel columns is disposed between two of the first pixel columns, and at least one of the first pixel columns is disposed between two of the second pixel columns.

2. The display panel of claim 1, wherein the three first subpixels of the first pixel comprise a first red subpixel, a first green subpixel, and a first blue subpixel, and the three second subpixels of the second pixel comprise a second red subpixel, a second green subpixel, and a second blue subpixel; and in the second direction, the first red subpixel and the second red subpixel are alternately arranged, the first green subpixel and the second green subpixel are alternately arranged, and the first blue subpixel and the second blue subpixel are alternately arranged.

3. The display panel of claim 2, wherein at least two of the first red subpixels in the first pixel columns and at least two of the second red subpixels in the second pixel columns are arranged in a first oblique line, at least two of the first green subpixels in the first pixel columns and at least two of the second green subpixels in the second pixel columns are arranged in a second oblique line, and at least two of the first blue subpixels in the first pixel columns and at least two of the second blue subpixels in the second pixel columns are arranged in a third oblique line; and an angle between the first oblique line and the second direction, an angle between the second oblique line and the second direction, and an angle between the third oblique line and the second direction are the same.

4. The display panel of claim 2, wherein at least two of the first red subpixels in the first pixel columns and at least two of the second red subpixels in the second pixel columns are arranged in at least one first wavy line, at least two of the first green subpixels in the first pixel columns and at least two of the second green subpixels in the second pixel columns are arranged in at least one second wavy line, and at least two of the first blue subpixels in the first pixel columns and at least two of the second blue subpixels in the second pixel columns are arranged in at least one third wavy line.

5. The display panel of claim 1, wherein the predetermined sequence is corresponding to an arrangement sequence of the scan lines in the first direction.

6. The display panel of claim 1, wherein a transmitting time difference between two scan signals of two adjacent ones of the scan lines has a predetermined time.

7. A display panel, comprising:

a pixel array, comprising:

at least two first pixel columns, each of the first pixel columns comprising at least two first pixels, the at least two first pixels being arranged in a matrix form in a first direction, each of the first pixels comprising at least three first subpixels, and the at least three first subpixels being arranged according to a first predetermined sequence in the first direction; and at least two second pixel columns, each of the second pixel columns comprising at least two second pixels, the at least two second pixels being arranged in a matrix form in the first direction, each of the second pixels comprising at least three second subpixels, and the at least three second subpixels being arranged according to a second predetermined sequence in the first direction, wherein the first pixel columns and the second pixel columns are parallelly arranged in a second direction, and the second direction is perpendicular to the first direction;

at least one first data line being electrically connected to one of the first pixel columns and one of the second pixel columns; and at least one second data line being electrically connected to the one of the second pixel columns and another one of the first pixel columns adjacent to the one of the second pixel columns;

wherein in two adjacent ones of subpixel rows, the first data line is electrically connected to one of the first subpixels in the one of the first pixel columns and one of the second subpixels in the one of the second pixel columns, and the second data line is electrically connected to one of the second subpixels in the one of the second pixel columns and one of the first subpixels in the another one of the first pixel columns adjacent to the one of the second pixel columns;

the subpixel rows are parallel to the second direction, and the subpixel rows at least comprise the first subpixels and the second subpixels.

8. The display panel of claim 7, wherein the three first subpixels of the first pixel comprise a first red subpixel, a first green subpixel, and a first blue subpixel, and the three second subpixels of the second pixel comprise a second red subpixel, a second green subpixel, and a second blue subpixel; and in the second direction, the first red subpixel and the second red subpixel are alternately arranged, the first green subpixel and the second green subpixel are alternately arranged, and the first blue subpixel and the second blue subpixel are alternately arranged.

9. The display panel of claim 8, wherein at least two of the first red subpixels in the first pixel columns and at least two of the second red subpixels in the second pixel columns are arranged in a first oblique line, at least two of the first green subpixels in the first pixel columns and at least two of the second green subpixels in the second pixel columns are arranged in a second oblique line, and at least two of the first blue subpixels in the first pixel columns and at least two of the second blue subpixels in the second pixel columns are arranged in a third oblique line; and an angle between the first oblique line and the second direction, an angle between the second oblique line and the second direction, and an angle between the third oblique line and the second direction are the same.

10. The display panel of claim 8, wherein at least two of the first red subpixels in the first pixel columns and at least two of the second red subpixels in the second pixel columns are arranged in at least one first wavy line, at least two of the first green subpixels in the first pixel columns and at least two of the second green subpixels in the second pixel columns are arranged in at least one second wavy line, and at least two of the first blue subpixels in the first pixel columns and at least two of the second blue subpixels in the second pixel columns are arranged in at least one third wavy line.

11. The display panel of claim 7, further comprising:

at least two scan lines being parallel to the second direction, the at least one scan lines being arranged in a matrix form in the first direction, and each of the scan lines being electrically connected to each of subpixels in corresponding one of the subpixel rows;

wherein the at least two scan lines are utilized for transmitting scan signals to the subpixel rows electrically connected to the scan lines according to a predetermined sequence in the first direction.

12. The display panel of claim 11, wherein the predetermined sequence is corresponding to an arrangement sequence of the scan lines in the first direction.

13. The display panel of claim 11, wherein a transmitting time difference between two scan signals of two adjacent ones of the scan lines has a predetermined time.

14. A display device, comprising:

a scan driving circuit for providing scan signals;

a data driving circuit for providing data signals; and a display panel, the scan driving circuit and the data driving circuit being electrically connected to the display panel, the display panel comprising:

a pixel array, comprising:

at least two first pixel columns, each of the first pixel columns comprising at least two first pixels, the at least two first pixels being arranged in a matrix form in a first direction, each of the first pixels comprising at least three first subpixels, and the at least three first subpixels being arranged according to a first predetermined sequence in the first direction; and at least two second pixel columns, each of the second pixel columns comprising at least two second pixels, the at least two second pixels being arranged in a matrix form in the first direction, each of the second pixels comprising at least three second subpixels, and the at least three second subpixels being arranged according to a second predetermined sequence in the first direction, wherein the first pixel columns and the second pixel columns are parallelly arranged in a second direction, and the second direction is perpendicular to the first direction;

at least one first data line being electrically connected to one of the first pixel columns and one of the second pixel columns; and at least one second data line being electrically connected to the one of the second pixel columns and another one of the first pixel columns adjacent to the one of the second pixel columns, wherein in two adjacent ones of subpixel rows, the first data line is electrically connected to one of the first subpixels in the one of the first pixel columns and one of the second subpixels in the one of the second pixel columns, and the second data line is electrically connected to one of the second subpixels in the one of the second pixel columns and one of the first subpixels in the another one of the first pixel columns adjacent to the one of the second pixel columns; and the subpixel rows are parallel to the second direction, and the subpixel rows at least comprise the first subpixels and the second subpixels.

15. The display device of claim 14, wherein the three first subpixels of the first pixel comprise a first red subpixel, a first green subpixel, and a first blue subpixel, and the three second subpixels of the second pixel comprise a second red subpixel, a second green subpixel, and a second blue subpixel; and in the second direction, the first red subpixel and the second red subpixel are alternately arranged, the first green subpixel and the second green subpixel are alternately arranged, and the first blue subpixel and the second blue subpixel are alternately arranged.

16. The display device of claim 15, wherein at least two of the first red subpixels in the first pixel columns and at least two of the second red subpixels in the second pixel columns are arranged in a first oblique line, at least two of the first green subpixels in the first pixel columns and at least two of the second green subpixels in the second pixel columns are arranged in a second oblique line, and at least two of the first blue subpixels in the first pixel columns and at least two of the second blue subpixels in the second pixel columns are arranged in a third oblique line; and an angle between the first oblique line and the second direction, an angle between the second oblique line and the second direction, and an angle between the third oblique line and the second direction are the same.

17. The display device of claim 15, wherein at least two of the first red subpixels in the first pixel columns and at least two of the second red subpixels in the second pixel columns are arranged in at least one first wavy line, at least two of the first green subpixels in the first pixel columns and at least two of the second green subpixels in the second pixel columns are arranged in at least one second wavy line, and at least two of the first blue subpixels in the first pixel columns and at least two of the second blue subpixels in the second pixel columns are arranged in at least one third wavy line.

18. The display device of claim 14, wherein the display panel further comprises at least two scan lines being parallel to the second direction, the at least two scan lines are arranged in a matrix form in the first direction, and each of the scan lines are electrically connected to each of subpixels in corresponding one of the subpixel rows; and the at least two scan lines are utilized for transmitting the scan signals to the subpixel rows electrically connected to the scan lines according to a predetermined sequence in the first direction.

19. The display device of claim 18, wherein the predetermined sequence is corresponding to an arrangement sequence of the scan lines in the first direction.

20. The display device of claim 18, wherein a transmitting time difference between two scan signals of two adjacent ones of the scan lines has a predetermined time.

* * * * *